US006020682A

United States Patent [19]

Holzer

[11] Patent Number: 6,020,682

[45] Date of Patent: Feb. 1, 2000

[54] FLUORESCENT LAMP WITH REPLACEABLE LAMP PART

[76] Inventor: Walter Holzer, Drosteweg 19, D-88709 Meersburg, Germany

[21] Appl. No.: 08/780,735

[22] Filed: Jan. 8, 1997

[30] Foreign Application Priority Data

Jan. 10, 1996 [DE] Germany ..... 196 00 531

[51] Int. Cl.[7] ..... H01J 1/62

[52] U.S. Cl. ..... 313/493; 313/318.01; 313/331; 313/623; 313/624

[58] Field of Search ..... 313/485, 493, 313/318.01, 318.02, 318.05, 318.12, 331, 623, 634, 51

[56] References Cited

U.S. PATENT DOCUMENTS

| | | | |
|---|---|---|---|
| 5,144,192 | 9/1992 | Barthelmes | 313/623 X |
| 5,729,085 | 3/1998 | Sica et al. | 313/634 X |
| 5,751,104 | 5/1998 | Soules et al. | 313/409 |

*Primary Examiner*—Ashok Patel
*Attorney, Agent, or Firm*—Marshall, O'Toole, Gerstein, Murray & Borun

[57] ABSTRACT

A fluorescent lamp wherein the replaceable gas discharge bulb assembly is equipped with parallel pins which are formed directly in the bulb assembly. Due to this modular construction, the bulbs can be used in a variety of applications.

4 Claims, 2 Drawing Sheets

FLUORESCENT LAMP WITH REPLACEABLE LAMP PART

BACKGROUND OF THE INVENTION

Fluorescent lamps have been gradually supplanting incandescent lamps owing to their enormous energy savings of as much as 80% relative to ordinary incandescent lamps. Some shortcomings, like larger dimensions, unusual appearance and even the comparatively very high price have had to be tolerated.

The task of the invention is to eliminate these shortcomings, to devise a cost-effective product that is economical to manufacture and at the same time to offer new possibilities of configuration by means of modular design.

SUMMARY OF THE INVENTION

This is achieved according to the present invention in that the lamp parts or fluorescent bulbs are extremely simplified by equipping them as module components with plug pins arranged in parallel that are melted directly into the ends of the gas discharge tubes without base mounting. The bulbs can then be directly plugged into the housing which contains the required connections for the power supply. The housing can contain only terminals for the power supply in addition to the spring loaded mounting clamps for the gas discharge vessel or additionally accept at least parts of the ballasts of one or more gas discharge vessels.

Another fluorescent lamp according to the invention has a housing with a connection part to the power mains (either a screw base with Edison threading or a bayonet holder) and can therefore be used in commercial lamps as a "compact lamp".

At higher wattages the lamp parts thus far have been produced from several U-shaped glass tubes that are melted together in intricate fashion to a single gas discharge vessel.

It is proposed according to the invention that several independent gas discharge vessels of simple design with lower wattage be provided that consist only of a single U-shaped glass tube and that separate current limiters be arranged for each lamp part.

For gas discharge vessels of lower wattage it is even possible to use inductive and/or capacitive series resistors as current limiters in the ballasts, which are set for the line frequency and avoid costly electronic circuits.

Another advantage of the invention is that differently shaped lamp parts can be interchangeably inserted into the housing in a fluorescent lamp, if desired. This is an important expansion of previous capabilities, since uniform housings that are economical to manufacture can be configured into fluorescent lamps of different appearance.

To make the design of the fluorescent lamp as simple and reliable as possible it is additionally proposed that detents be provided on the plug pins in the form of thickenings or reductions of cross section in order to secure the lamp parts against falling out. Such detents can be provided, for example, on the ends of the plug pins, as heads, similar to the heads of pins.

In order to also accommodate higher wattages at limited length, it is proposed that a doubly coiled gas discharge vessel with plug pins be used as additional module component according to the invention. This design also permits space-saving accommodation of parts of the ballast with its current limiters, since sufficient space is present between the coils.

The independent gas discharge vessels can also be made simple to connect and disconnect in order to save a dimmer.

The task of the invention to devise a modular system naturally requires configuration of the individual components in the simplest form. It is therefore also prescribed that gas discharge vessels consisting of only a single bent glass tube be provided.

The use of cold cathodes instead of heated electrodes is particularly suitable for a design with plug pins, since the number of required electrical connections is virtually halved.

When several lamp parts are present in a fluorescent lamp, there is the possibility of providing a common power supply and connecting separate current limiters for each gas discharge vessel, especially in gas discharge vessels operated with high frequency.

Better utilization of the sometimes very cramped space in fluorescent lamps is an advantage of the layout of the gas discharge tubes according to the invention, where sufficient space to accommodate at least parts of the ballast can be provided between the ends of the gas discharge vessel provided with plug pins.

For better understanding of the invention some examples are now described that are in no way to be understood as limiting. The principle of the invention is to devise a modular design for fluorescent lamps that can be expanded at will in design and area of application.

Figures 15, 16, 17, 18, 19, 20, 21, 22:
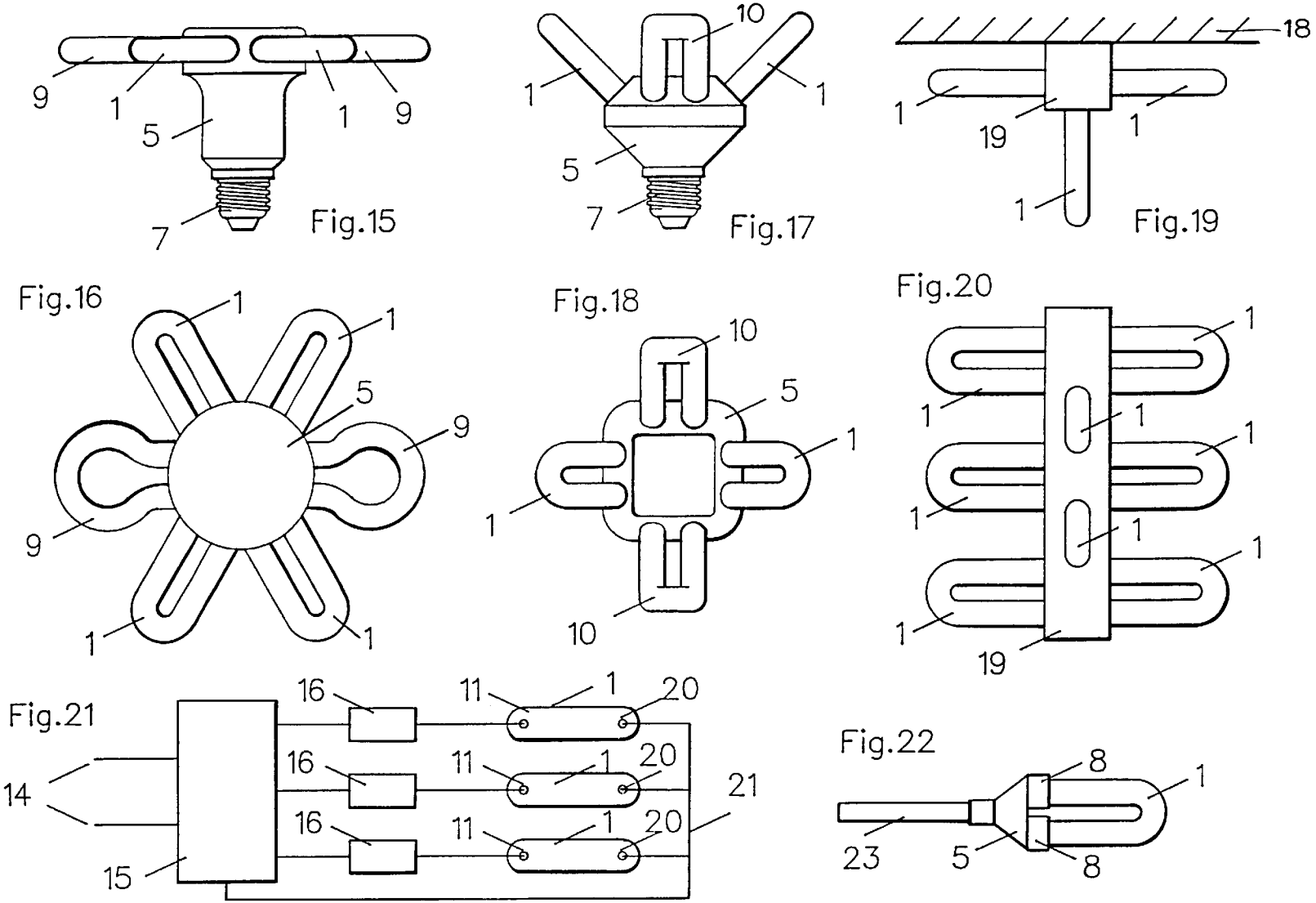
FIG. 15 shows a stellate arrangement of gas discharge vessels, which has not been attainable thus far with assembled and melted glass tubes.
FIG. 16 is the corresponding profile.

The combination shown in FIGS. 17 and 18 has also become possible only by the independent arrangement of gas discharge vessels and their power supplies.

FIGS. 19 and 20 show a ceiling light assembled in modular fashion from a larger number of individual gas discharge vessels (1).

FIG. 21 schematically depicts a circuit diagram for several gas discharge lamps.

FIG. 22 shows a gas discharge vessel with a housing for connection of the power supply as an example of an extremely simple and economical solution.

DETAILED DESCRIPTION OF THE DRAWINGS

Examples of embodiments of the present invention are described in detail below. In all the drawings the same parts are given the same reference numbers.

Figures 1, 2, 3, 4, 5, 6, 7, 8, 9, 10, 11, 12, 13, 14:
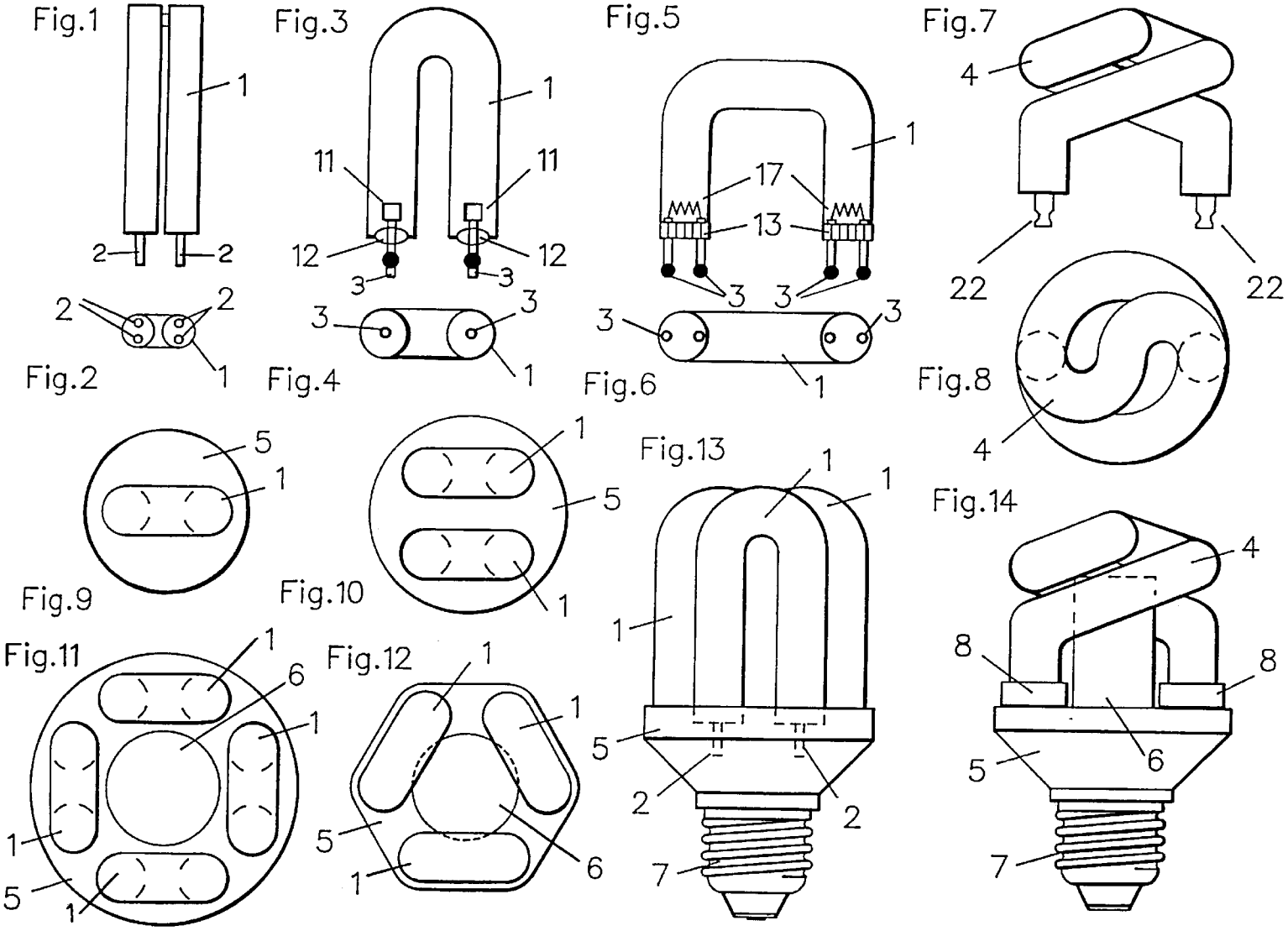
FIGS. 1 to 8 show examples of different gas discharge vessels (1), in accordance with the invention.
FIGS. 9 to 12 show the arrangement of gas discharge vessels (1) on housings (5) as compact fluorescent lamps.
FIG. 13 shows a compact fluorescent lamp according to the invention with three U-shaped gas discharge vessels (1).
FIG. 14 shows a compact fluorescent lamp with a doubly coiled gas discharge vessel.

The basic form of a gas discharge vessel (1) shown in FIG. 1 for example consists of two straight glass tubes joined together by melting. Even this design of a gas discharge vessel (1) can be viewed as equivalent to the bent glass tubes according to the invention shown in FIGS. 3 and 5. FIGS. 2, 4 and 6 are corresponding views of the pin sides of the depicted gas discharge vessels (1).

In FIG. 1 the gas discharge vessel (1) is shown with smooth plug pins (2) which secure the position as a result of the limited weight of the lamp part even without special locking. However, a detent according to the invention is more reliable, for example, by arranging thickenings of the plug pins (3), as shown in FIGS. 3 and 5. In the drawing of FIG. 5 the thickenings can be seen on the end of the plug pin (3) similar to pin heads.

FIG. 7 shows another variant in which locking is achieved by constrictions on the plug pins.

A comparison of the spacings of plug pins (3) in FIGS. 1, 3, 5 and 7 makes it clear that the gas discharge vessels designed in simple fashion according to the invention permit adaptable modular design. Not only the spacings, but also the shapes can be interchangeably expanded into a modular system as shown, for example, in FIGS. 16 and 18.

A particularly advantageous variant of the concept according to the invention is shown in FIG. 7. This involves a doubly wound gas discharge vessel (4) produced from a tube. In this stable form it is also possible to implement greater discharge lengths in short designs. As is apparent in FIGS. 8 and 14, sufficient space is available within double coil (4) to accommodate at least part of a ballast (6) in space-saving fashion. The possibility of arranging parts of the ballast in the center of several gas discharge vessels (1) is also shown in FIGS. 11 and 12. In these designs several gas discharge vessels (1) are positioned around a centrally arranged ballast (6).

As shown in FIG. 13, which represents an overall view of the compact lamp of FIG. 12 with connection part (7) to the power mains, extremely favorable dimensions are achieved owing to the fact that the ballast (6) need not be accommodated merely in housing (5), but can also lie between the gas discharge vessels (1).

In all fluorescent lamps produced thus far a common advantage is that during failure of the gas discharge vessel (1) it can be replaced with a new one in the simplest manner. A true module-adapter solution!

This applies in the simplest variants, as shown in FIGS. 9 and 10, but also especially in the complex solutions of FIGS. 15 to 20.

The overall depiction of two examples of compact fluorescent lamps according to the invention the FIGS. 13 and 14 supplement the aforementioned descriptions. FIG. 13 corresponds to the profile of a hexagonal housing as shown in FIG. 12. Since the ballast (6) lies between the gas discharge vessels (1), this significantly reduces the design height of the housing (5) and thus the height of the entire lamp.

The same applies to the compact lamp in FIG. 14 with a double coil (4) as a one-part gas discharge vessel. Although this lamp is also viewed as an "adapter lamp" owing to the separability of lamp part and ballast, this property can no longer be observed externally. Bushings (8), which are firmly connected to housing (5), better stabilize the inserted gas discharge vessel (4) and offer electrical contact protection.

Although a modular design is also possible in gas discharge lamps with heated electrodes, a special combination advantage according to the invention consists of the fact that cold cathodes are at least partially provided. These cold cathodes have the major modular advantage that only one plug pin (3) is required, in contrast to heated electrodes, which require two plug pins (3).

FIG. 5 schematically shows melting of the plug pins (3) in a pinch base (13) with the corresponding heating coil (17). The plug pins can be arranged in a row, as shown in FIG. 5, or oriented as shown in FIG. 1.

An arrangement according to FIG. 3 is simpler and therefore more expedient when using cold cathodes (11). In this case the plug pins (3) are melted with bead bases (12) into the gas discharge vessel (1) and carry the cold cathodes (11). The type of melting, however, is insignificant for the purpose of the invention.

FIGS. 2, 4 and 6 show a view of the gas discharge vessels (1) when viewing the plug pins (2) and (3).

Cold cathodes also have the advantage that they ignite the gas discharge without delay immediately on engagement. No preheating is required.

Since gas discharge vessels (1) with short discharge paths are used in the fluorescent lamps according to the invention owing to the limited wattage, the ignition and burning voltages can also be kept low so that in many cases special ignition or voltage doubling circuits can be dispensed with. A simple ballast with capacitive or inductive series resistors as current-limiting device is the most cost-effective solution.

The inductive "choke-ballast" that has been used for many years testifies to the technical useability of such simple ballasts.

The simplified circuit diagram in FIG. 21, however, shows that an additional simplification is possible with several gas discharge vessels (1), despite the individually connected current limiters (16), if a common power supply (15) is connected. A line (21) connects the cold cathodes (20) to the power supply (15). This circuit simplification is primarily significant in the use of gas discharge vessels (1) with high frequency, since in this case a more costly electronic converter is required as power supply (15).

FIGS. 15 to 20 and FIG. 22 can be viewed as examples of expanded configuration possibilities by the separation of individual gas discharge vessels according to the invention. They are representative of the almost unlimited number of new designs, for example, as a replacement for current-consuming halogen lamps in lights, for floodlights and for all types of demanding ornamental lights.

FIG. 15 shows a stellate compact lamp that could never be designed in this fashion with welded together glass tubes in the previous technology. It produces a full-surface light, but nevertheless has the advantage of an adapter lamp with very limited service cost. FIG. 16 is a view of this lamp seen in the direction of the base.

Different gas discharge vessels (1) and (9) can be used in the same compact lamp (also subsequently) in this example. New personal design wishes are attainable.

FIG. 17 is an example of a spatially designed compact lamp that is characterized above all by particularly good light distribution, since radiation is favored in the radial and axial directions by the oblique position of the gas discharge vessel (1). Here again the use of two different gas discharge vessels (1) and (10) is shown in FIG. 18.

This lamp can be viewed as an additional example of similar solutions that are attainable by the invention, sometimes as a synergistic effect, by combining ideas according to the invention.

The ceiling lamp shown in FIGS. 19 and 20 can be viewed as a representative example of the enormous expansion capability of the module system according to the invention in lighting design.

A whole series of gas discharge vessels (1) is inserted in a light strip (19) in this example, which is attached to the ceiling (18). The gas discharge vessels (1) can then be arranged either parallel to ceiling (18) or perpendicular to it, as shown in FIG. 19. However, any oblique positions are also possible, like that of the compact lamp of FIG. 17.

Use of the modular principle is permitted in lighting design by versions as shown in FIG. 22. The gas discharge vessel (1) is inserted into bushing (8) of housing (5), which can be directly pushed or screwed onto a tube (23), as is common in lighting design.

The housing (5) contains either just connection terminals, for example, screw or spring terminals for connection wires to the ballast or also components of the ballast, or a complete ballast.

Such versions not only represent an enormous saving from elimination of the previous screw versions, but also eliminate the potential threat to life from such components that are not safe with respect to contact.

For fluorescent lamps with several gas discharge vessels it is recommended according to the circuit diagram in FIG. 21 that a common power supply (15) in network (14) be provided with connection of several parallel-connected current limiters (16) to the gas discharge vessels (1). In the case of high frequency-operated fluorescent lamps the power supply (15) would be an ac-dc converter. The electrodes (20) can be connected via a common line (21) to the power supply (15).

An exhaustive representation of the application possibilities of the invention is practically impossible, whether they be individual lamps or light strips or polygonal or zig-zag strips or the like. A new world is opened up for such modular solutions according to the invention. Consistent application of the idea according to the invention opens up new opportunities for interior architects and designers.

We claim:

1. A fluorescent lamp comprising:

a) a replaceable gas discharge vessel comprising a single bent glass tube having parallel plug pins at first and second ends thereof;

b) the first end of the glass tube base-mounted to the fluorescent lamp by parallel pins;

c) the second end of the glass tube having the parallel pins melted directly thereto; and d) a current limiter and a ballast mounted as a separate unit for electrical connection to said gas discharge vehicle.

2. The fluorescent lamp of claim 1 further comprising a locking mechanism on said plug pins, said locking mechanism comprising a thickening on at least of one of said plug pins.

3. The fluorescent lamp of claim 1 further comprising a locking mechanism on said plug pins, said locking mechanism comprising a reduction in the cross section of at least one of said plug pins.

4. The fluorescent lamp of claim 1 further comprising a locking mechanism on said plug pins, said locking mechanism comprising a head on the end of at least one of said plug pins.

* * * * *